US008496537B1

(12) United States Patent
Shao

(10) Patent No.: US 8,496,537 B1
(45) Date of Patent: Jul. 30, 2013

(54) GOLF PUTTING TRAINING DEVICE

(76) Inventor: Michael Shao, Edison, NJ (US)

( * ) Notice: Subject to any disclaimer, the term of this patent is extended or adjusted under 35 U.S.C. 154(b) by 0 days.

(21) Appl. No.: 13/187,315

(22) Filed: Jul. 20, 2011

(51) Int. Cl.
*A63B 69/36* (2006.01)

(52) U.S. Cl.
USPC ..... 473/227; 473/276; 473/409

(58) Field of Classification Search
USPC ..... 473/207, 212, 219, 226, 227, 257, 473/266, 276
See application file for complete search history.

(56) References Cited

U.S. PATENT DOCUMENTS

| | | | | |
|---|---|---|---|---|
| 4,145,054 | A | 3/1979 | Stewart | |
| 4,170,356 | A | 10/1979 | Banks | |
| 5,009,426 | A | 4/1991 | Cox | |
| 5,013,045 | A * | 5/1991 | Elmore | 473/229 |
| 5,310,188 | A | 5/1994 | Hernberg | |
| 5,413,329 | A * | 5/1995 | Hirsch | 473/238 |
| 5,501,464 | A * | 3/1996 | Dalbo | 473/213 |
| 5,851,156 | A | 12/1998 | Schwark, Jr. | |
| 5,904,624 | A * | 5/1999 | Martinez | 473/212 |
| 6,491,591 | B1 | 12/2002 | Schuster | |
| 6,857,970 | B2 * | 2/2005 | Robbins | 473/276 |
| 6,932,713 | B1 | 8/2005 | Kim | |
| 7,033,284 | B2 * | 4/2006 | Yoshimura | 473/276 |

FOREIGN PATENT DOCUMENTS

| | | |
|---|---|---|
| AU | 610276 | 11/1989 |
| GB | 2.250.444 | 10/1992 |
| GB | 2.458.512 | 9/2009 |

* cited by examiner

*Primary Examiner* — Nini Legesse
(74) *Attorney, Agent, or Firm* — Michael I. Kroll

(57) ABSTRACT

A golf putting-training device attachable to a golf club having a deformable rod member that is be shaped into a triangular configuration with a rod insert end then placed into a rod receptacle affiliated with a golf club fastener element forming a spaced apart triangular guide from said golf club wherethen the user forms a similar triangle extending from their hands, through the arms and between the shoulders and uses the guide to identify unwanted joint flexure or rotation during a putt thereby enabling corrective action.

15 Claims, 11 Drawing Sheets

GOLF PUTTING TRAINING DEVICE

BACKGROUND OF THE INVENTION

1. Field of the Invention

The present invention relates generally to golf devices and, more specifically, to a golf putting-training device attachable to a golf club with a rod deformable to a triangular shape substantially conforming to the triangular shape of the user extending from the hands through the arms and across the shoulders with the guide serving to identify unwanted user joint flexure or rotation during a putt thereby enabling corrective action by the user in performing a pendulum like putt swing.

2. Description of the Prior Art

There are other golf devices designed for swing training. While these golf device may be suitable for the purposes for which they were designed, they would not be as suitable for the purposes of the present invention as heretofore described.

It is thus desirable to provide a golf putting-training device that is mountable to a golf club with a deformable rod that can be configured to a triangular shape as a spaced away shape guide for the user's hands extending through the arms and across the shoulders.

It is further desirable to provide a golf putting-training device that can be releasably fastened to the shaft or grip portion of the club.

SUMMARY OF THE PRESENT INVENTION

A primary object of the present invention is to provide a golf training device for golf putting.

Another object of the present invention is to provide a golf training device comprising a deformable rod and club fastener that incorporates a rod receptacle for receiving an end of said deformable rod.

Yet another object of the present invention is to provide a golf training device wherein said deformable rod is bent into a triangular shape as needed during a putting training session.

Still yet another object of the present invention is to provide a golf training device wherein said golf club-fastener comprises club mounting means and rod receptacle with receptacle extension arm therebetween to keep the triangular rod spaced away from the user during a putt training sessions.

Another object of the present invention is to provide a golf training device wherein said golf club fastener is the golf club mounting means having receptacle extension arm projecting therefrom.

Yet another object of the present invention is to provide a golf training device wherein said golf club mounting means may incorporate releasable tensioning of the mounting means for selectively relocating said golf club mounting means to a desired club location.

Still yet another object of the present invention is to provide a golf training device wherein said golf club mounting means may be a tension clip so that the golf training device can be releasably attached to the golf club shaft or hand grip.

An additional object of the present invention is to provide a golf training device wherein said golf club mounting means further provides for a fastener comprising a conically shaped receptacle whereby said golf training device can be releasably pressed onto the end of the handgrip.

Additional objects of the present invention will appear as the description proceeds.

The present invention overcomes the shortcomings of the prior art by providing a golf putting-training device attachable to a golf club having a deformable rod member that can be shaped into a triangular configuration imitating the user's triangular shape formed at the hands extending through the arms and across the shoulders wherethen the deformable rod is placed into a rod receptacle serving as a guide in helping the user to maintain their triangular shape while executing a putt and identifying unwanted joint flexure or rotation during the putt thereby enabling user corrective action.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
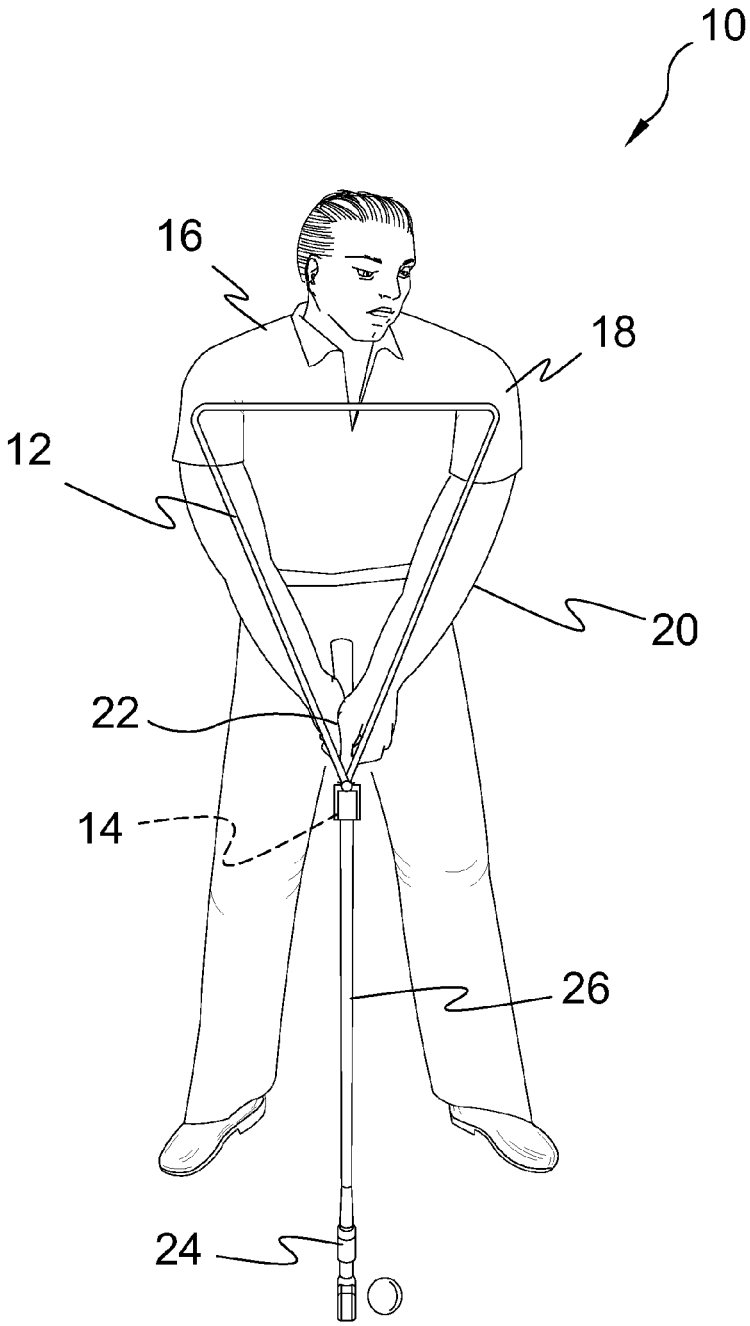
FIG. 1 is an illustrative view of the present invention in use.

Turning now descriptively to the drawings, in which similar reference characters denote similar elements throughout the several views, the figures illustrate the Golf Putting Training Device of the present invention. With regard to the reference numerals used, the following numbering is used throughout the various drawing figures.

10 Golf Putting Training Device of the present invention
12 deformable rod
14 golf club mounting means
16 user
18 shoulder of 16
20 arm of 16
22 hand of 16
24 putter
26 shaft of 24
28 receptacle insertion portion of 12

30 distal end of 12
32 tension clip
34 gripping element
36 wing of 32
38 pivot point
40 extension arm
42 rod receptacle
44 rod receptacle aperture of 42
46 hand grip of 24
48 conical mounting means

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention in use. The present invention is a golf putting training device 10 comprising a light weight, weather resistant, deformable rod 12 and a fastener element serving as golf club mounting means 14 attachable to the shaft 26 of a putter 24. The deformable rod 12 is hand bent into a triangular shape by the user 16 conforming to the triangular shape formed by the shoulders 18, arms 20 and hands 22 when assuming a putting stance. The device helps a player monitor their hands, arms and shoulders relative to the triangle guide helping the player develop the feel of a one-piece pendulum swing motion.

Figure 2:
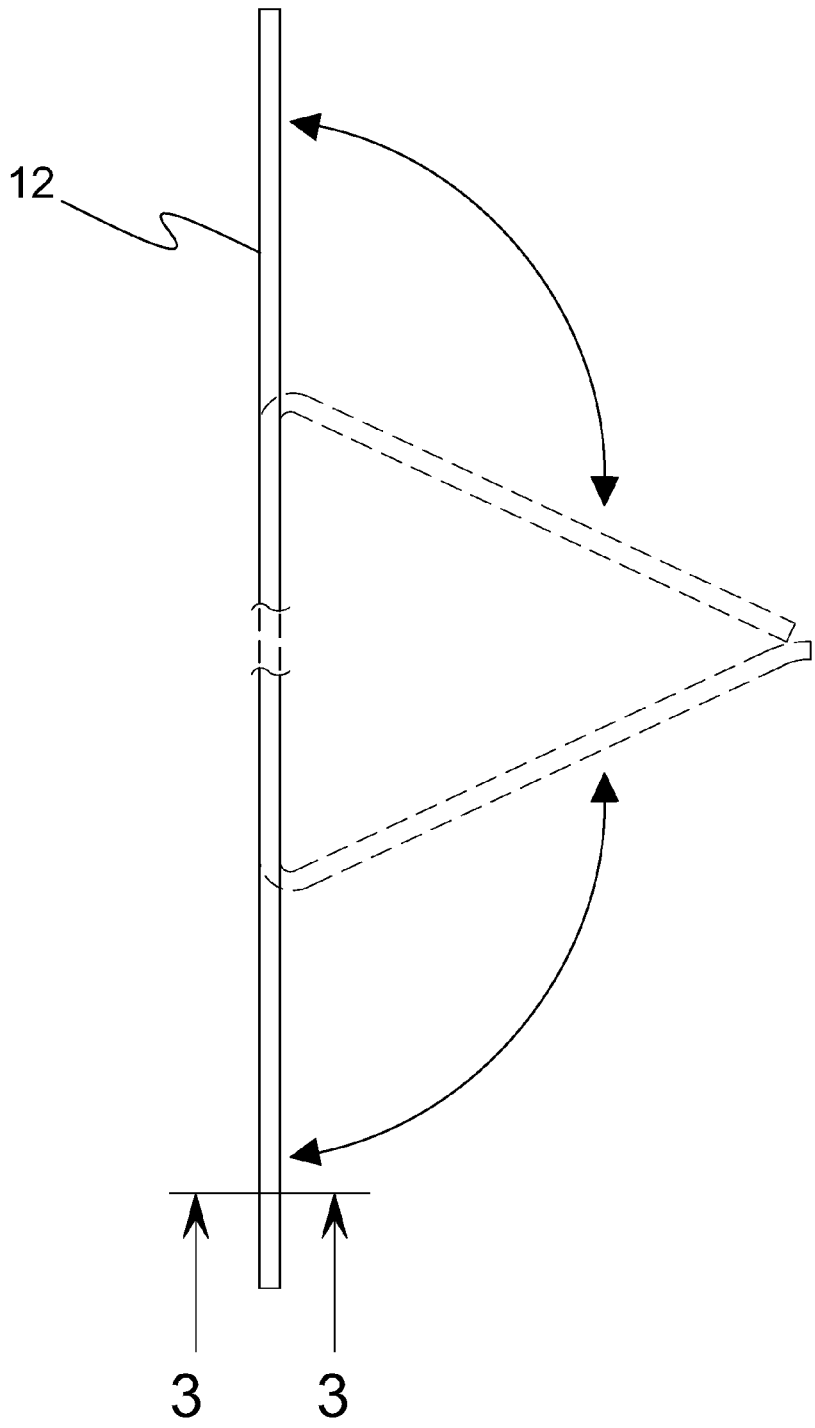
FIG. 2 is a front view of the deformable rod of the present invention.

FIG. 2 is a front view of the deformable rod 12 of the present invention. Shown is the light weight, weather resistant, hand bendable rod or golf putting triangle rod of the present invention prior to being bent into a triangular shape by the user, conforming to the triangular shape formed by the shoulders, arms and hands when assuming a putting stance. The rod alternately provides a receptacle insertion portion 28 that fits within a provided rod receptacle aperture.

Figure 3:
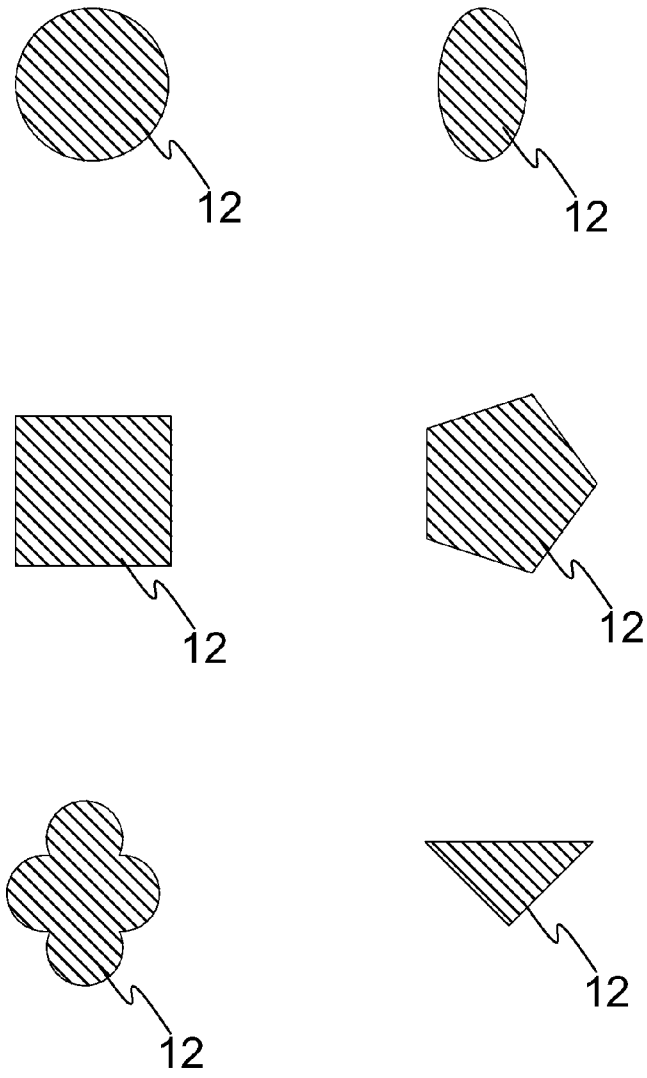
FIG. 3 are cross sectional views of rod shapes provided by the present invention.

FIG. 3 are cross sectional views of rod shapes provided by the present invention. The present invention provides a deformable rod 12 that is hand bendable by the user to mimic the user's triangular formed by the shoulders, arms and hands when assuming a putting stance. The rod 12 shape is selected from the group of polygon, circle, oval and irregular shape.

Figure 4:
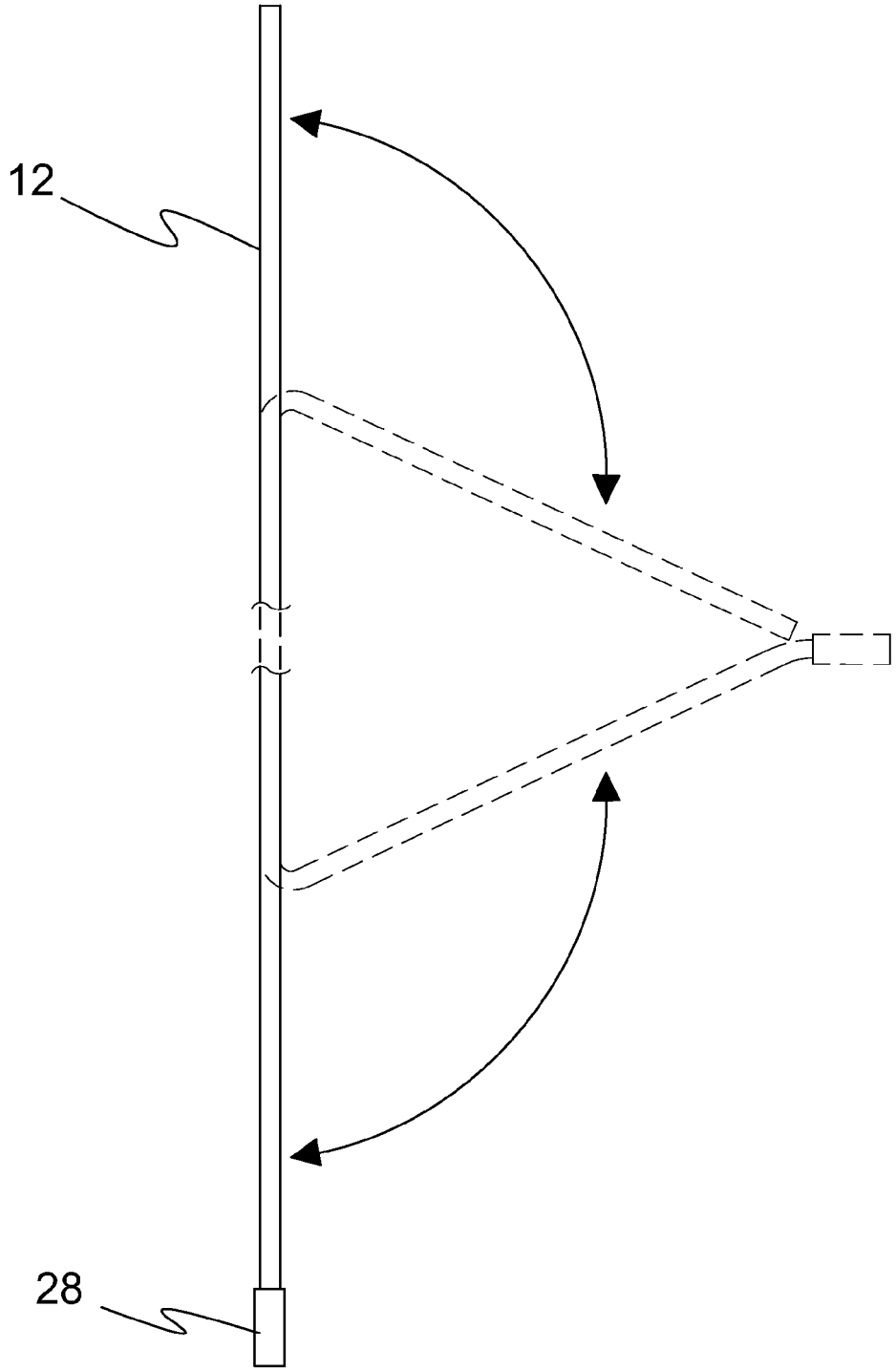
FIG. 4 depicts and additional element of the present invention.

FIG. 4 depicts and additional element of the present invention. The present invention provides an additional element for the rod comprising a receptacle insertion portion 28. Therefore, the present invention provides that the rod 12 may have a circular cross section while the additional element of the receptacle insertion portion 28 may take the form of the aforementioned rod shapes in lieu of the rod itself.

Figure 5:
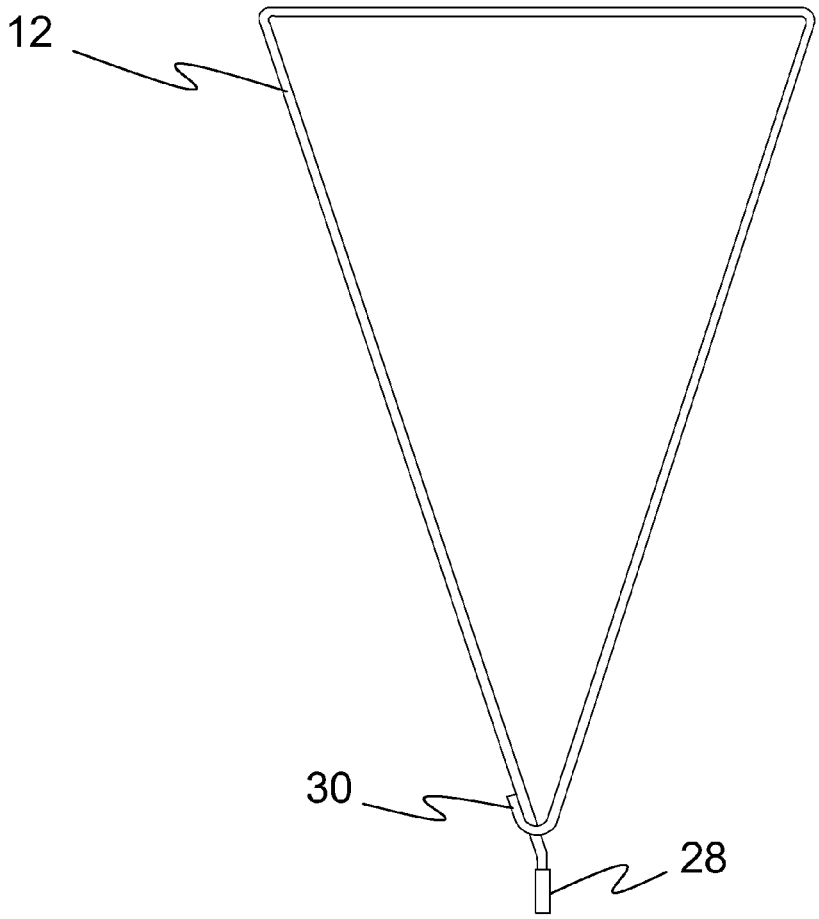
FIG. 5 is a front view of the deformable rod of the present invention.

FIG. 5 is a front view of the deformable rod 12 of the present invention. Shown is the light weight, weather resistant, hand bendable rod or golf putting triangle rod of the present invention bent to the triangular shape formed by the user's shoulders, arms and hands when assuming a putting stance. The distal end 30 can be bent to overlap on any side of the triangle. The rod 12 provides an insertion end 28 that fits within a club-fastened receptacle.

Figure 6:
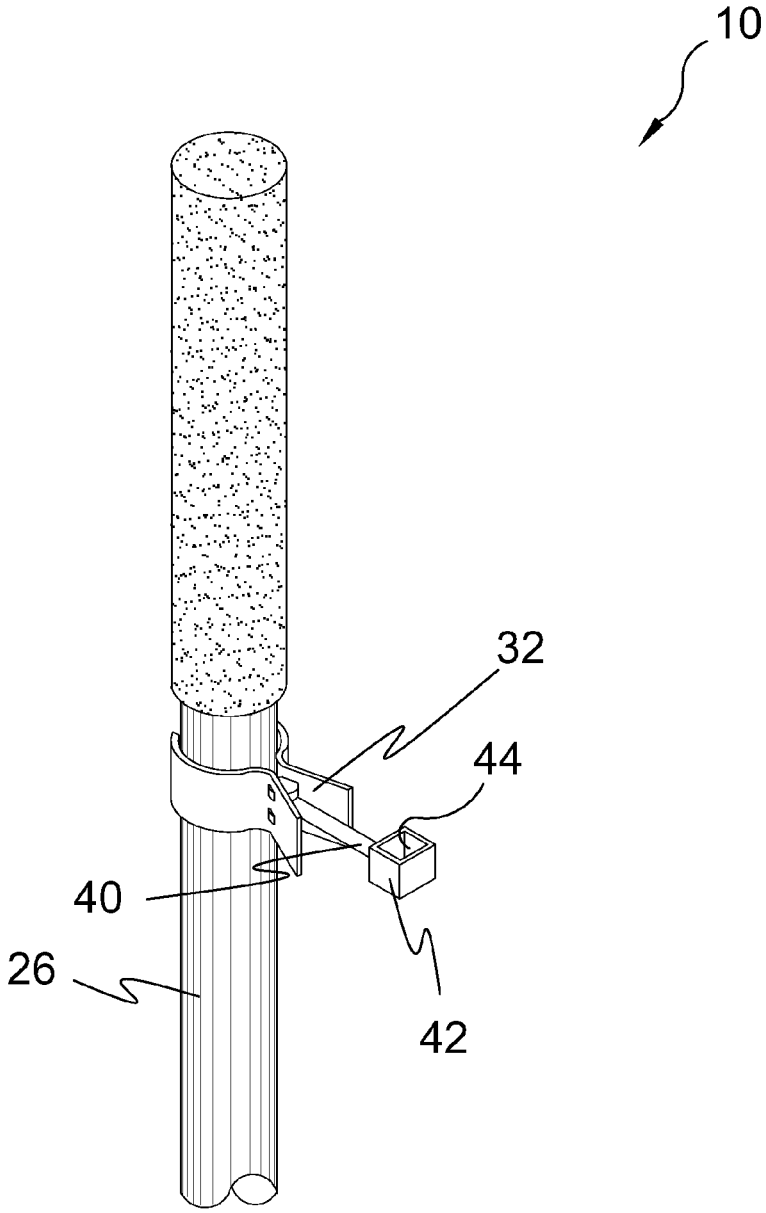
FIG. 6 is a perspective view of the present invention.

FIG. 6 is a perspective view of the present invention. Shown is golf putting training device 10 with the tension clip 32 having a rod receptacle 42 with a rod receptacle aperture 44 spaced apart from the putter shaft 26 by an extension arm 40 that may be malleable so that the triangularly shaped rod can be moved to a desired position relative to the user. The tension clip 32, for illustrative purposes only is shown as a spring clip having an extension arm 40 to space the rod receptacle 42 away from the golf club.

Figure 7:
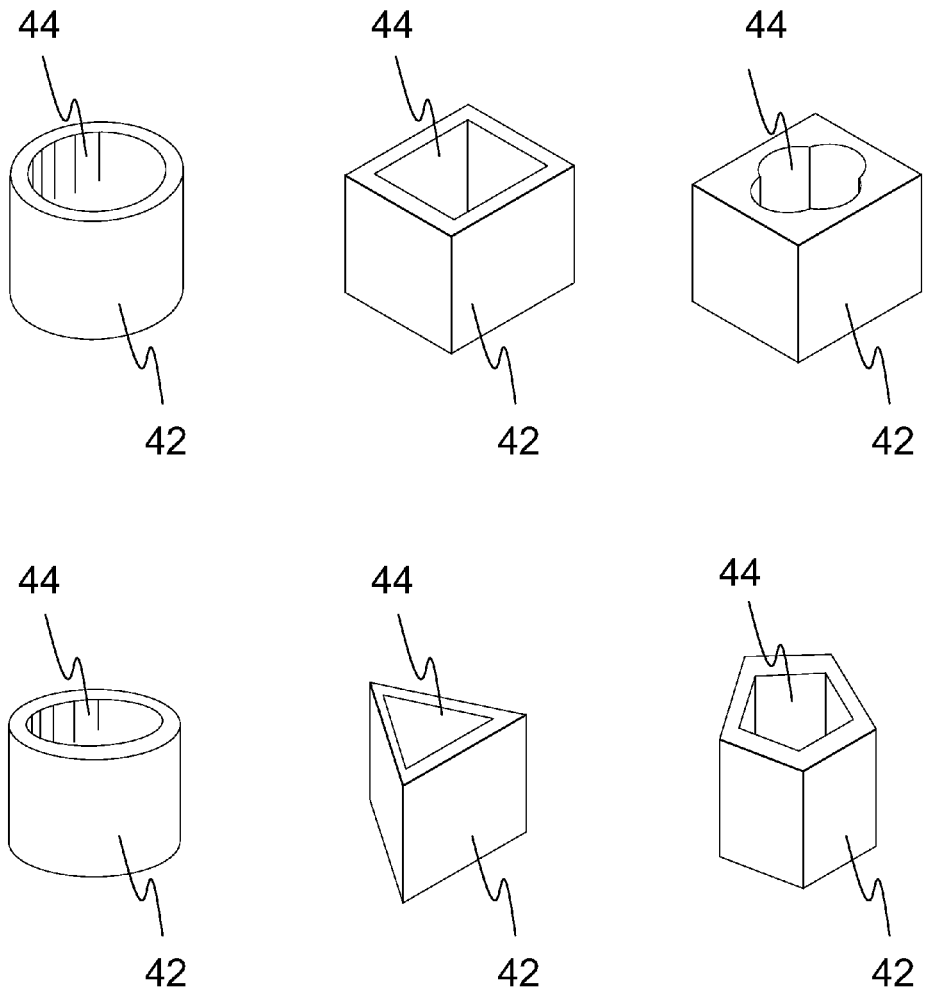
FIG. 7 are cross sectional views of rod receptacles having aperture shapes corresponding to the aforementioned rod shapes.

FIG. 7 are cross sectional views of rod receptacles having aperture shapes corresponding to the aforementioned rod shapes. The present invention envisions that the rod receptacle 42 housing may have any shape while preferably the receptacle aperture 44 has a shape corresponding to the rod 12 cross sectional shape or that of the of the present invention. The present invention provides a deformable rod 12 that is hand bendable by the user to mimic the user's triangular formed by the shoulders, arms and hands when assuming a putting stance. The rod 12 shape is selected from the group of polygon, circle, oval and irregular.

Figure 8:
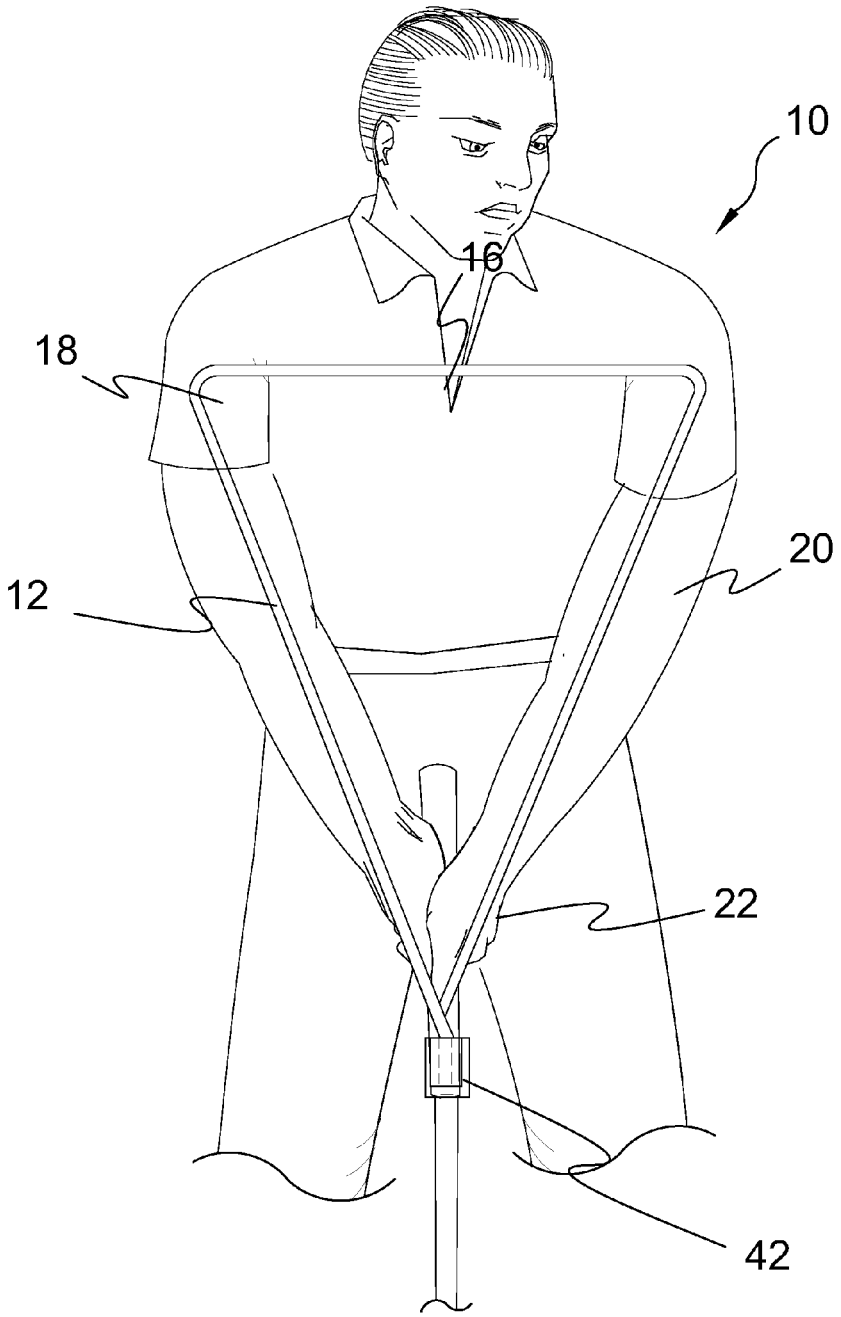
FIG. 8 is an illustrative view of the present invention in use.

FIG. 8 is an illustrative view of the present invention in use. Shown is the golf putting training device 10 with hand bendable deformable rod 12 formed into a triangular configuration by the user 16 conforming to the triangular shape formed by the shoulders 18, arms 20 and hands 22 when assuming a putting stance. The device helps a player monitor and visualize the shape of the triangle in the putting stroke, and helps the player develop the feel of a one-piece pendulum swing motion.

Figure 9:
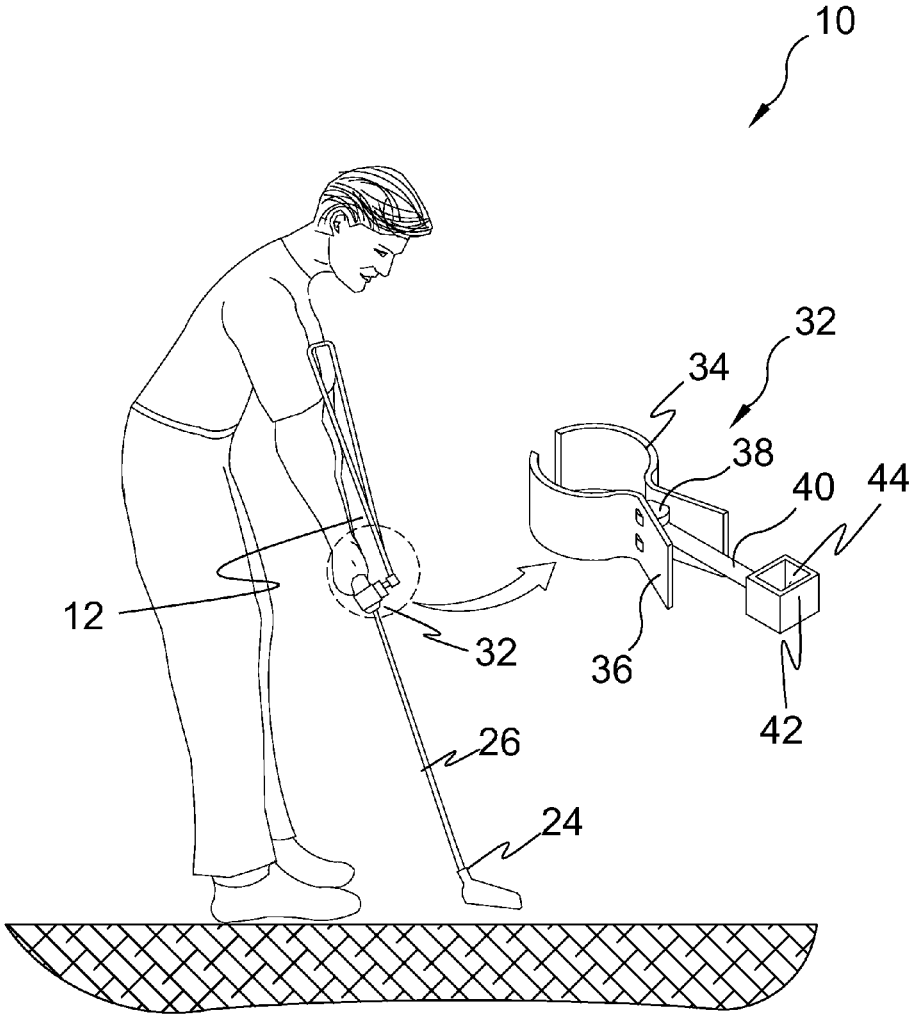
FIG. 9 is an illustrative view of the present invention in use.

FIG. 9 is an illustrative view of the present invention in use. Shown is the golf putting training device 10 with the triangulated deformable rod 12 mounted in the tension clip 32 fastened to the shaft 26 of a golf putter 24. The tension clip 32 comprises a pair of semi-circular gripping elements 34 and their respective outwardly flaring wings 36 pivotally connected at the pivot point 38 from which an extension arm 40 projects with a rod receptacle 42 defining an internal rod receptacle 42 disposed on the distal end thereof.

Figure 10:
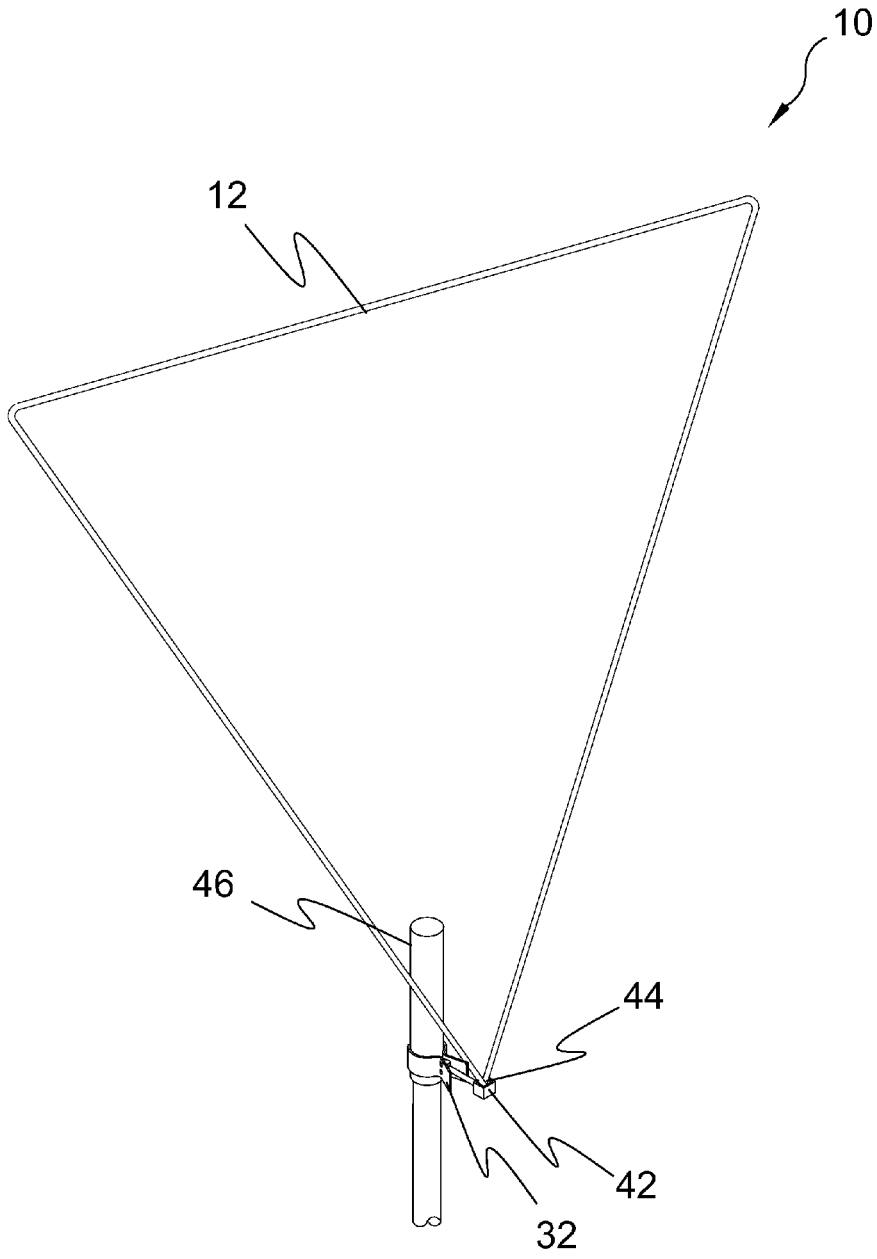
FIG. 10 is a perspective view of the present invention.

FIG. 10 is a perspective view of the present invention. Shown is the golf putting training device 10 mounted on the hand grip 46 of the putter and the triangulated deformable rod 12 disposed therein.

Figure 11:
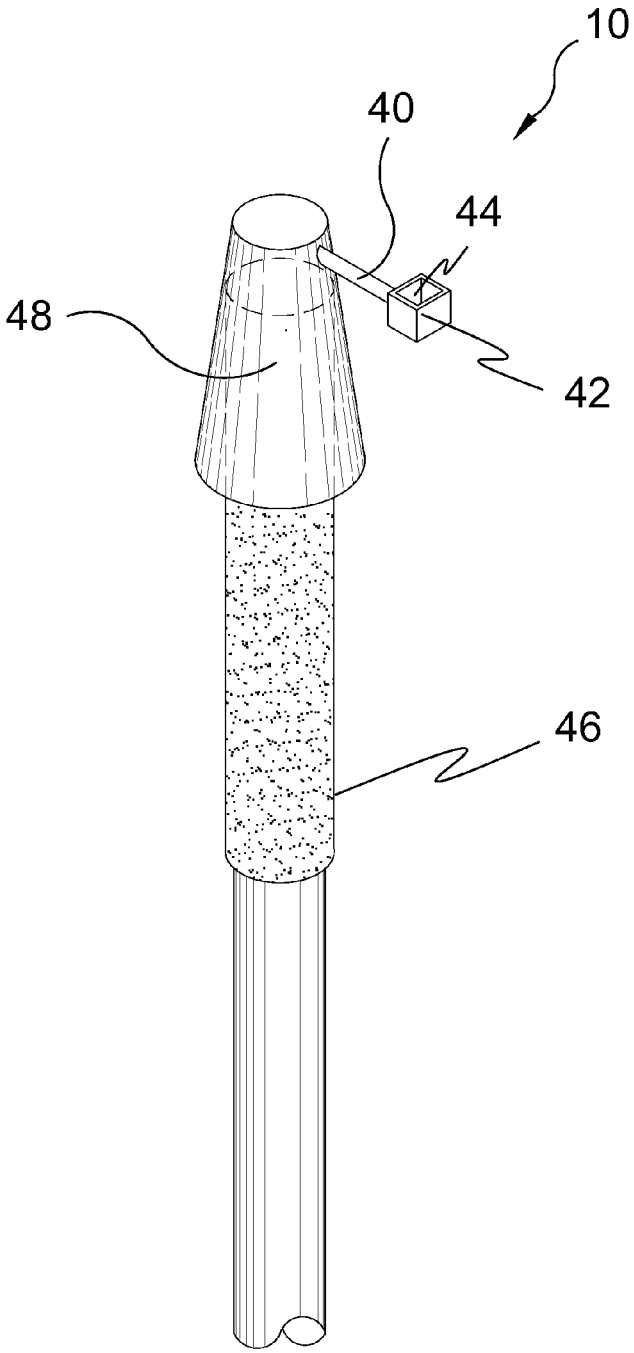
FIG. 11 is an additional enablement of the golf training device.

FIG. 11 is an additional enablement of the golf putting training device 10. Shown is a golf club having a deformable conical receptacle mounting means 48 frictionally fastened to the hand grip 46-having rod receptacle 42 and rod receptacle aperture 44 spaced away by an extension arm 40 so that the triangulated deformable rod 12 does not contact the golfer during use.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A golf putting training device for aiding a user in learning to consistently execute a pendulum like swing while putting comprising:

a) a fastener adjacent a grip at an upper end of a golf club putter for mounting said golf putting training device to said golf club putter;

b) said training device comprising a rod that is user deformed to a shape conforming to a triangle having converging sides aligned with arms of said user gripping said putter and a top side stretching between shoulders of said user, said training device not making contact with said user during use; and c) said converging sides coming together at said fastener with one side thereof attached to said fastener and another side wrapped around said one side.

2. The golf putting training device according to claim 1, further comprising an extension arm projecting from said fastener having a receptacle on a distal end for mounting said rod thereto.

3. The golf putting training device according to claim 2, wherein said extension arm is malleable so that the user can move said rod to a desired position relative to the user.

4. The golf putting training device according to claim 3, wherein said user aligns his shoulders, arms and hands respectively with said base and sides of said triangulated deformable rod while gripping said golf putter and maintaining said alignment through a putting stroke thereof.

5. A golf putting training device attachable to a golf putter to allow the user to identify unwanted joint flexure as recited in claim 4, wherein an insertion end of said deformable rod and a rod receptacle of said rod insert are substantially conformed of a substantially similar size and shape to restrict to inadvertent rotation thereof during usage.

6. A golf putting training device attachable to a golf putter to allow the user to identify unwanted joint flexure as recited in claim 5, wherein said insertion end of said deformable rod is placed in said rod receptacle, the shoulders, arms and hands of the user being aligned with the base and sides of said deformable rod during movement of the putter.

7. The golf putting training device according to claim 2, wherein said rod receptacle has a rod receptacle aperture selected from the group of polygon, circle, oval and irregular shape.

8. The golf putting training device according to claim 7, wherein said rod receptacle aperture and a inserted rod portion have a substantially similar cross section so that once placed within the rod receptacle aperture the rod will not rotate during use.

9. The golf putting training device according to claim 7, wherein a tension clip is fastened to the shaft of said golf putter by a pair of wings gripping elements around said shaft.

10. The golf putting training device according to claim 1, wherein said rod has a cross sectional area selected from the group of polygon, circle, oval and irregular shape.

11. The golf putting training device according to claim 10, wherein said rod has a receptacle insertion portion having a cross sectional area selected from the group of polygon, circle, oval and irregular shape.

12. The golf putting training device according to claim 1, wherein said fastener is a tension clip.

13. The golf putting training device according to claim 1, wherein said fastener is a conical receptacle that is frictionally mountable to a grip end of a golf putter.

14. A golf putting training device attachable to a golf putter to allow a user to identify unwanted joint flexure thereby enabling corrective action comprising:

a) a deformable rod having an insertion end and a distal end and deformed to configure a triangulated guide to conform to a putting grip of a user according to a distance between shoulders and an angular placement of arms and hands of said user;

b) a fastener element comprising a tension clip adjacent a grip on an upper end of a shaft on a golf putter for selectively fastening to a longitudinal location on said shaft of said golf putter;

c) a rod insert attached to said fastener element defining a rod receptacle for insertion of said insertion end of said deformable rod therein; and d) said triangulated guide being mounted in such a way as not to make contact with said user during use; wherein the tension clip further comprises:

a) a pair of semicircular gripping elements for releasable attachment to said golf putter with each gripping element having a wing member flaring outwardly therefrom;

b) a pivot point disposed between said gripping elements and their respective wing members and pivotally connecting them therewith while providing a bias drawing said gripping elements toward one another; and c) an extension arm projecting from said pivot point with said rod insert disposed on the distal end thereof thereby maintaining said rod insert in a spaced apart relation with said golf club.

15. A method of utilizing a golf putting training device attachable to a golf putter to allow a user to identify and correct unwanted joint flexure comprising the steps:

a) providing a deformable rod having an insertion end that is hand bendable to configure a triangular guide to conform to a putting grip of a user according to a distance between shoulders and an angular placement of the arms and hands of said user; a tension clip adjacent a grip on an upper end of a shaft on a golf putter for selectively fastening to a longitudinal location on said shaft of said golf putter having by employing a pair of semicircular gripping elements for releasable attachment thereto with each gripping element having a wing member flaring outwardly therefrom for separating said gripping elements; a pivot point disposed between said gripping elements and their respective wing members and pivotally connecting them therewith while providing a bias drawing said gripping elements toward one another, an extension arm projecting from said pivot point with said rod insert disposed on a distal end thereof thereby maintaining said rod insert in a spaced apart relation with said golf club, a rod insert defining a rod receptacle for insertion of an insertion end of said deformable rod therein;

b) positioning a medial portion of said deformable rod below the shoulders of said user and bending it downward at ends equidistant to said shoulders at angles aligned with the user's arms with an insertion end terminating just below said user's hands;

c) wrapping any excessive length of an end of the triangulated deformable rod opposing said insertion end around an insertion end;

d) fastening said tension clip to said golf putter shaft immediately below the hands of said user gripping said golf putter;

e) inserting said insertion end of said deformable rod into said rod receptacle; and f) aligning the shoulders, arms and hands thereof with an upper, substantially horizontal base and sides of said triangulated deformable rod respectively and maintaining said alignment during the swing of the practice putting stroke, said training device not making contact with the user doing use thereof.

* * * * *